US006261442B1

(12) United States Patent
Ambrosino et al.

(10) Patent No.: US 6,261,442 B1
(45) Date of Patent: Jul. 17, 2001

(54) PROCESS FOR CONVERTING HYDROCARBONS BY TREATMENT IN A DISTILLATION ZONE COMPRISING WITHDRAWING A STABILIZED DISTILLATE, ASSOCIATED WITH A REACTION ZONE, AND ITS USE FOR HYDROGENATING BENZENE

(75) Inventors: Jean-Louis Ambrosino, Ternay; Blaise Didillon; Pierre Marache, both of Rueil Malmaison; Jean-Charles Viltard, Vienne; Gérald Witte, Viroflay, all of (FR)

(73) Assignee: Institut Francais du Petrole (FR)

( * ) Notice: Subject to any disclaimer, the term of this patent is extended or adjusted under 35 U.S.C. 154(b) by 0 days.

(21) Appl. No.: 09/285,679

(22) Filed: Apr. 5, 1999

(30) Foreign Application Priority Data

Apr. 6, 1998 (FR) ..... 98 04351

(51) Int. Cl.[7] ..... C10G 7/00

(52) U.S. Cl. ..... 208/92; 208/143; 585/264; 585/265

(58) Field of Search ..... 208/143, 92; 585/264, 585/265

(56) References Cited

U.S. PATENT DOCUMENTS

| | | | |
|---|---|---|---|
| 3,655,551 | 4/1972 | Hass et al. | 208/59 |
| 3,926,785 | 12/1975 | Siegel | 208/211 |
| 4,302,356 | 11/1981 | Smith, Jr. | 252/426 |
| 4,622,955 | 5/1987 | Lipkin et al. | 203/98 |
| 5,073,236 | 12/1991 | Gelbein et al. | 203/29 |
| 5,302,356 | 4/1994 | Shadman et al. | 422/186.3 |
| 5,362,377 | 11/1994 | Marker | 208/133 |
| 5,817,227 * | 10/1998 | Mikitenko et al. | 208/143 |
| 5,914,435 | 6/1999 | Streicher et al. | 585/819 |

FOREIGN PATENT DOCUMENTS 0 781 830 7/1997 (EP) .

* cited by examiner

*Primary Examiner*—Helane E. Myers
(74) *Attorney, Agent, or Firm*—Millen, White, Zelano & Branigan, P.C.

(57) ABSTRACT

The invention provides a process for converting a hydrocarbon feed in which said feed is treated in a distillation zone producing an overhead vapour distillate and a bottom effluent, associated with an at least partially external reaction zone comprising at least one catalytic bed, in which at least one reaction for converting at least a portion of at least one hydrocarbon is carried out in the presence of a catalyst and a gas stream comprising hydrogen, the feed for the reaction zone being drawn off at the height of at least one draw-off level and representing at least a portion of the liquid flowing in the distillation zone, at least part of the effluent from the reaction zone being re-introduced into the distillation zone at the height of at least one re-introduction level, so as to ensure continuity of the distillation, said process being characterized in that a liquid distillate is withdrawn from the distillation zone at the height of at least one withdrawal level, said level being located below the vapour distillate withdrawal level. This process can be used to reduce the benzene content in a hydrocarbon cut.

18 Claims, 2 Drawing Sheets

Figure 1:
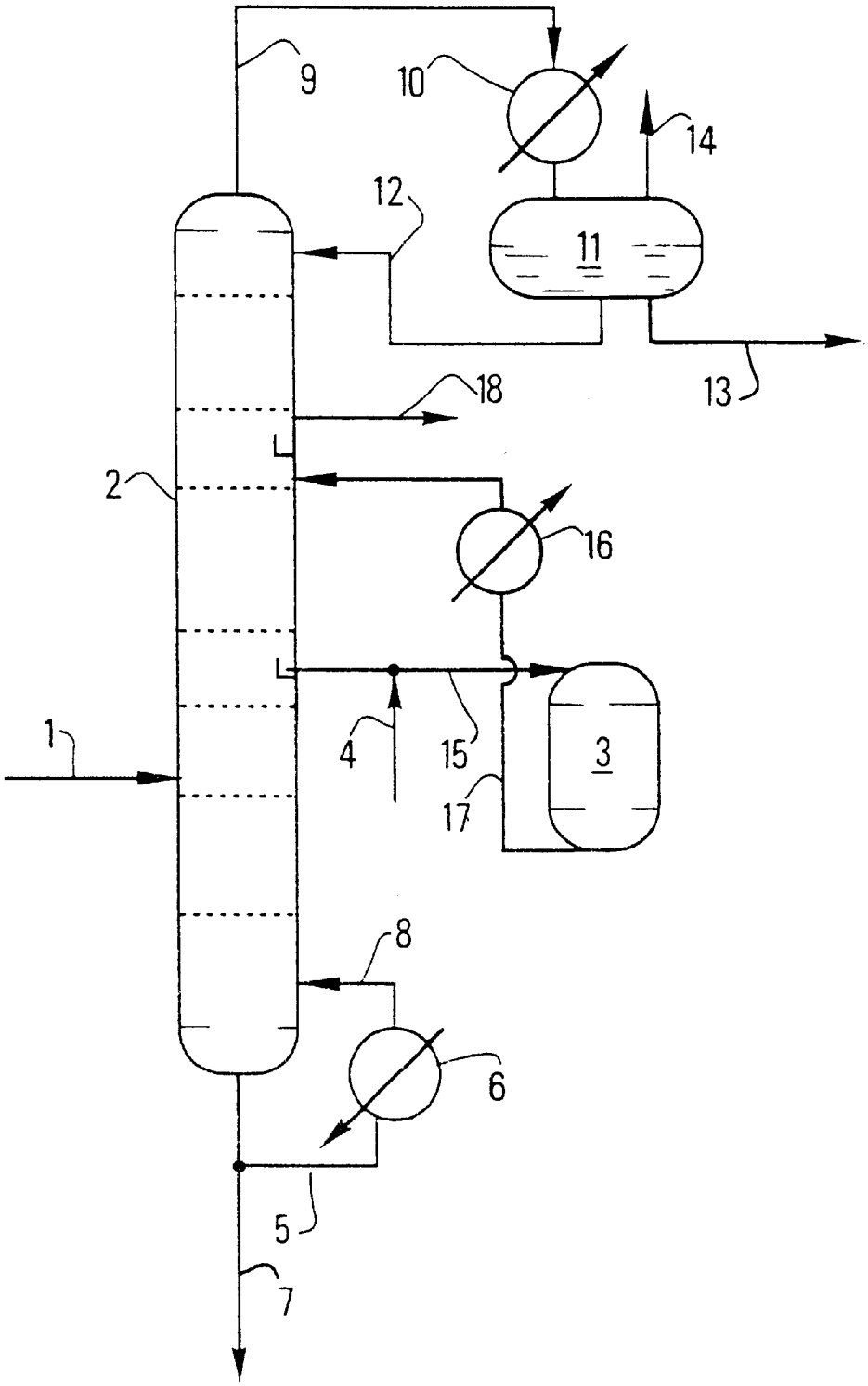

PROCESS FOR CONVERTING HYDROCARBONS BY TREATMENT IN A DISTILLATION ZONE COMPRISING WITHDRAWING A STABILIZED DISTILLATE, ASSOCIATED WITH A REACTION ZONE, AND ITS USE FOR HYDROGENATING BENZENE

Cross Reference To Related Application

This application is related to applicants' concurrently filed application Attorney Docket No. Pet-1748, entitled "Process For Converting Hydrocarbons By Treatment In A Distillation Zone Comprising A Circulating Reflux, Associated With A Reaction Zone, And Its Use For Hydrogenating Benzene", based on French Application 98/04.352 filed Apr.6, 1998, said applications being incorporated by reference herein.

The invention relates to a process for converting hydrocarbons. The process of the invention associates a distillation zone with a hydrocarbon conversion reaction zone which is at least partially external to the distillation zone. Thus this process can selectively convert hydrocarbons separated from a hydrocarbon feed by means of the distillation zone.

More particularly, the process of the invention is applicable to selective reduction of the quantity of light unsaturated compounds (i.e., containing at most six carbon atoms per molecule) comprising benzene and possibly olefins in a hydrocarbon cut essentially comprising at least 5 carbon atoms per molecule, with no substantial loss of octane number.

The general trend now is to reduce the quantity of benzenes and olefins (unsaturated compounds) in gasolines, because of their known toxicity.

Benzene has carcinogenic properties and thus the possibility of it polluting the air must be limited as far as possible, in particular by practically excluding it from automobile fuels. In the United States, reformulated fuels must not contain more than 1% by volume of benzene; in Europe, it has been recommended that a gradual decrease towards that value be made.

Olefins are known to be among the most reactive hydrocarbons in photochemical reactions with oxides of nitrogen, which occur in the atmosphere and which lead to the formation of ozone. A rise in the concentration of ozone in the air may be a source of respiratory problems. It is thus desirable to reduce the amount of olefins in gasolines, and more particularly of the lightest olefins which have the greatest tendency to vaporise when manipulating a fuel.

The benzene content of a gasoline is very largely dependent on that of the reformate component in that gasoline. The reformate results from catalytic treatment of naphtha intended to produce aromatic hydrocarbons, principally comprising 6 to 9 carbon atoms per molecule and the octane number of which is very high endowing the gasoline with antiknock properties.

Because of the toxicity described above, the amount of benzene in the reformate must be reduced by a maximum.

The benzene in a reformate can be hydrogenated to cyclohexane. Since it is impossible to selectively hydrogenate benzene in a mixture of hydrocarbons also containing toluene and xylenes, that mixture must first be fractionated to isolate a cut containing only benzene, which can then be hydrogenated.

International patent application WO 95/15934 describes a reactive distillation which aims to selectively hydrogenate diolefins and C2–C5 acetylenic compounds. The distillate can be separately recovered from the light compounds. The catalytic hydrogenation zone is completely internal to the distillation column, which means that the hydrogen cannot dissolve properly in the feed and the pressure cannot be increased.

A process has been described in which the catalytic benzene hydrogenation zone is internal to the distillation column has been described which separates benzene from other aromatic compounds (Benzene Reduction—Kerry Rock and Gary Gildert CDTECH—1994 Conference on Clean Air Act Implementation and Reformulated Gasoline—October 94), which cuts the cost of the apparatus. It appears that the pressure drop across the catalytic bed(s) in that process means that an intimate mixture between the liquid phase and the gaseous stream containing the hydrogen cannot be obtained. In that type of technology where the reaction and distillation proceed simultaneously in the same physical space, the liquid phase descends through every catalytic bed in the reaction zone in a trickle flow, and thus in threads of liquid. The gaseous fraction containing the fraction of vaporised feed and the gas stream containing hydrogen rise through the catalytic bed in columns of gas. In that arrangement, the entropy of the system is high and the pressure drop across the catalytic bed(s) is low. As a result, operating that type of technique cannot easily promote dissolution of hydrogen in the liquid phase comprising the unsaturated compound(s).

The Applicant's European patent application EP-A-0 781 830 describes a process for hydrogenating benzene using a distillation column associated with a reaction zone which is at least partially external. The effluent is recovered overhead from the column, then arrives in a drum via a condenser from which a new separation operation is necessary to recover the desired product. The overhead effluent comprises light gases such as excess hydrogen mixed with the reformate which is depleted in benzene and the liquid distillate contains a great deal of dissolved gas which risks requiring a supplemental separation step.

The process of the present invention is an improvement over the Applicant's patent application EP-A-0 781 830, the features of which are hereby included in the present description.

The invention provides a process for converting a hydrocarbon feed associating a distillation zone producing a vapour distillate and a bottom effluent, and a reaction zone which is at least partially external to the distillation zone. At least one reaction for converting at least a portion of at least one hydrocarbon takes place in a reaction zone comprising at least one catalytic bed in the presence of a catalyst and a gas stream comprising hydrogen. The feed for the reaction zone is drawn off at the height of a draw-off level and represents at least a portion of the liquid flowing in the distillation zone, and at least a portion of the effluent from the reaction zone is re-introduced into the distillation zone at the height of at least one re-introduction level, so as to ensure continuity of distillation. The process is characterized in that a liquid distillate is withdrawn from the distillation zone at the height of at least one withdrawal level, said level being located below the vapour distillate withdrawal level.

The term "liquid distillate" as used in the present description means a liquid fraction withdrawn from a distillation zone which is distinct from the feed for the reaction zone.

The particular application of the process of the invention to a process for reducing the benzene content in a hydrocarbon feed enables a reformate which is depleted in benzene or, if necessary, which is almost completely free of benzene and other unsaturated hydrocarbons containing at most six carbon atoms per molecule such as light olefins to be produced from a crude reformate, directly recovering a stabilised liquid distillate, with no significant loss in yield.

The process of the invention is characterized by dissociating the level from which the liquid distillate is withdrawn from the level from which the gaseous distillate is recovered, the liquid distillate being withdrawn from a withdrawal level beneath that for recovering the vapour distillate. Thus the desired product is recovered as a stabilised liquid distillate, i.e., free of the major portion of excess hydrogen and possibly light gases. Further, such distinct vapour distillate recovery can eliminate gases other than the hydrogen present in the gas stream comprising for the most part hydrogen introduced to carry out the conversion reaction via the gaseous distillate.

Thus, for example, this particular application of the process of the invention can directly recover, by withdrawal from the distillation zone, a stabilised liquid distillate in which at least partial selective hydrogenation of benzene and any other unsaturated compound containing at most six carbon atoms per molecule and other than benzene which may be present in the feed has been carried out, while limiting hydrogenation of $C_7^+$compounds (i.e., containing at least seven carbon atoms per molecule).

The process of the invention is, for example, a process for treating a feed, the major portion of which is constituted by hydrocarbons containing at least 5 preferably 5 to 9, carbon atoms per molecule, and comprising at least one unsaturated compound, comprising benzene and possibly olefins in which said feed is treated in a distillation zone associated with a hydrogenation reaction zone which is at least partially external and comprises at least one catalytic bed, in which hydrogenation of at least a portion of the unsaturated compounds contained in the feed, containing at most six carbon atoms per molecule, i.e., containing up to six (inclusive) carbon atoms per molecule, is carried out in the presence of a hydrogenation catalyst and a gas stream comprising hydrogen, preferably in the major portion, the feed for the reaction zone being drawn off from the height of a draw-off level and representing at least a portion, preferably the major portion, of the liquid flowing in the distillation zone, at least a portion, preferably the major portion, of the effluent from the reaction zone being re-introduced into the distillation zone at a height of at least one re-introduction level, so as to ensure continuity of distillation, and so that a distillate which is highly depleted in unsaturated compounds is recovered, said process being characterized in that the distillate is withdrawn in liquid and stabilised form from at least one withdrawal level which is located below the recovery level for the vapour distillate containing hydrogen and light gases.

The withdrawn liquid distillate is stabilised. The liquid distillate is withdrawn from a withdrawal level below the recovery level for the light gases containing excess hydrogen. The light gases pass into a condenser then into a reflux drum from which at least a portion of the liquid fraction is recycled to the distillation zone and at least a portion of the liquid fraction can optionally be recovered.

When hydrogenating benzene, the stabilised liquid distillate essentially contains liquid compounds containing at least 5 carbon atoms and which can be directly used as fuels.

The level for re-introducing the feed which has been at least partially converted in the external reaction zone is generally located substantially below or substantially above or substantially at the same height of at least one draw-off level, preferably said level for drawing off feed from the distillation zone. Preferably, the re-introduction level is located above the draw-off level.

The withdrawal level for the stabillsed liquid distillate is generally located above or below or substantially at the same height as at least one level for re-introducing the feed which has been at least partially converted in the external reaction zone.

In a preferred implementation, the stabilised liquid distillate withdrawal level is located above at least one level for drawing off feed from the distillation zone.

The distillation zone generally comprises at least one column provided with at least one distillation contact means selected from the group formed by plates, bulk packing and structured packing, as is well known to the skilled person, such that the total global efficiency is equal to at least five theoretical plates. In cases known to the skilled person where using a single column can cause problems, it is preferable to split the zone and use two columns which, placed end to end, produce said zone.

The feed is introduced into the distillation zone at at least one introduction level located below the level for drawing off liquid towards the reaction zone, generally at a level of 10 to 40 theoretical plates and preferably 15 to 25 theoretical plates below the level for drawing off liquid towards the reaction zone, the draw-off level under consideration being the lowest.

The reaction zone generally comprises at least one catalytic bed, preferably 1 to 4 catalytic bed(s); when at least two catalytic beds are incorporated into the distillation zone, these two beds may be separated by at least one distillation contact means.

In the particular application of the process of the invention to the selective reduction of the amount of light unsaturated compounds comprising benzene and possibly olefins from a hydrocarbon cut, the reaction zone is a hydrogenation zone. In this case, the hydrogenation reaction zone carries out at least partial hydrogenation of benzene present in the feed, generally such that the benzene content in the stabilised liquid distillate is a maximum of a certain value, and said reaction zone hydrogenates at least part, preferably the major part, of any unsaturated compound containing at most six carbon atoms per molecule and other than benzene, which may be present in the feed.

The reaction zone is at least partially external to the distillation zone. Generally, the process of the invention includes 1 to 6, preferably 1 to 4 draw-off level(s) which supply the external portion of the zone. A portion of the external portion of the reaction zone which is supplied by a given draw-off level, if the external portion of the reaction zone comprises at least two draw-off levels, generally comprises at least one reactor, preferably a single reactor.

Since the reactor is at least partially external, a flow of liquid is drawn off which is equal to, greater than or less than the liquid traffic in the distillation zone located below the draw-off level for the feed to be converted.

In the particular application of converting feeds with a rather high benzene content, for example over 3% by volume, the flow rate of liquid drawn off is preferably equal to or greater than the liquid traffic in the distillation zone located below the draw-off level for the feed to be converted.

The process of the invention can convert a large portion of the compound(s) to be converted external to the distillation zone, possibly under pressure and/or temperature conditions which are different from those used in the distillation zone.

The process of the invention is such that the flow of liquid to be converted is generally co-current to the flow of the gas stream comprising hydrogen for all catalytic beds in the external portion of the reaction zone.

In a preferred implementation of the process of the invention, the reaction zone is completely external to the distillation zone towards the external portion of the reaction zone comprises at least two catalytic beds, each catalytic bed is supplied by a single draw-off level, preferably associated with a single re-introduction level, said draw-off level being distinct from the draw-off level which supplies the other catalytic bed(s).

In a preferred implementation of the process of the invention, the feed to be converted drawn off from the distillation zone towards the reaction zone is cooled before it enters the reactor. Similarly, the converted feed leaving the reactor can be cooled before re-introducing it into the distillation zone. This cooling creates a circulating reflux. In fact, in the context of the present description, the term "circulating reflux" means a circulation of a liquid drawn off from the distillation zone at one level and re-introduced to a higher level at a temperature which is lower than the temperature of the liquid at the draw-off level.

In the particular case of reducing the benzene content in a hydrocarbon cut, one preferred implementation of the invention is such that the level of re-introducing the hydrogenated feed into the column is located above the level for drawing off the feed to be hydrogenated, to a zone where the benzene content is the lowest. More preferably, the re-introduction level is located at least 2 theoretical plates above the draw-off level and more preferably, the level for re-introducing the feed is located at least 4 theoretical plates above the draw-off level for said feed.

The preferred implementation described above can substantially reduce the quantity of catalyst required. In fact, this implementation enables a large quantity of liquid to be drawn off from the distillation zone in order to convert a larger amount of benzene in the reactor without disturbing the traffic in the column outside the draw-off zone and without disturbing the concentration profile of the column. Re-introduction to a higher level can thus substantially reduce the quantity of catalyst necessary to obtain a quantity of benzene in the final effluent which is as low or even lower than in prior art processes.

Further, this preferred implementation of the invention can generally reduce the reboiling duty necessary for continuity of distillation.

In order to carry out hydrogenation using a particular application of the process of the invention, the theoretical mole ratio of hydrogen necessary for the desired conversion of benzene is 3. The quantity of hydrogen distributed upstream of or in the hydrogenation zone is optionally in excess with respect to this stoichiometry, and this must be higher when, in addition to the benzene in the feed, any unsaturated compound containing at least six carbon atoms per molecule present in said feed must be at least partially hydrogenated.

In general, the excess hydrogen, if any, can advantageously be recovered for example using one of the techniques described below. In a first technique, the excess hydrogen leaving the reaction zone is recovered either directly at the level of the effluent at the outlet from the reaction zone, or in the gaseous distillate from the distillation zone, then compressed and re-used in said reaction zone to create a reflux. In a second technique, the excess hydrogen which leaves the reaction zone is recovered, then injected upstream of the compression steps associated with a catalytic reforming unit, mixed with hydrogen from said unit, said unit preferably operating at low pressure, i.e., generally at an absolute pressure of less than 0.8 MPa.

The hydrogen included in the gas stream, used, for example, in the particular process of the invention for hydrogenating unsaturated compounds containing at most six carbon atoms per molecule, can originate from any source producing at least 50% by volume pure hydrogen, preferably at least 80% by volume pure hydrogen and more preferably at least 90% pure hydrogen. As an example, the hydrogen from catalytic reforming processes, methanation, PSA (pressure swing adsorption), electrochemical generation or steam cracking can be cited.

One preferred implementation of the process of the invention, which may or may not be independent of the preceding implementations, is such that the effluent from the bottom of the distillation zone is at least partially mixed with the stabilised liquid distillate withdrawn from a withdrawal level located below the vapour distillate recovery level. In the particular case when reducing the benzene content, the mixture obtained can be used as a fuel either directly, or by incorporation into fuel fractions.

When the reaction zone is partially internal to the distillation zone, the operating conditions for the portion of the reaction zone internal to the distillation zone are linked to the operating conditions for the distillation step. Distillation is carried out at an absolute pressure which is generally in the range 0.1 MPa to 2.5 MPa with a reflux ratio in the range 0.1 to 20. The temperature in the distillation zone is in the range 10° C. to 300° C. In general, the liquid to be converted is mixed with a gas stream comprising hydrogen the flow rate of which is equal to at least the stoichiometry of the conversion reactions carried out and is at most equal to the flow rate corresponding to 10 times the stoichiometry. In the external portion of the reaction zone, the catalyst is located in every catalytic bed using any technology which is known to the skilled person under operating conditions (temperature, pressure, . . .) which may or may not be independent, preferably independent, of the operating conditions of the distillation zone. In the portion of the reaction zone external to the distillation zone, the operating conditions are generally as follows. The absolute pressure required is generally in the range 0.1 to 6 MPa. The operating temperature is generally in the range 30° C. to 400° C. The space velocity in said reaction zone, calculated with respect to the catalyst, is generally in the range 0.5 to 60 $h^{-1}$. The flow rate of hydrogen corresponding to the stoichiometry of the conversion reactions carried out is in the range 1 to 10 times said stoichiometry.

In the particular case of hydrogenating benzene and other unsaturated compounds, the operating conditions are as follows. When the hydrogenation zone is partially internal to the distillation zone, the operating conditions for the portion of the hydrogenation zone internal to the distillation zone are linked to the operating conditions for the distillation step. Distillation is carried out at an absolute pressure generally in the range 0.2 to 2 MPa, preferably in the range 0.4 to 1 MPa, with a reflux ratio in the range 0.1 to 10, preferably in the range 0.2 to 1. The temperature at the head of the zone is generally in the range 30° C. to 180° C. and the temperature at the bottom of the zone is generally in the range 120° C. to 280° C. The hydrogenation reaction is carried out under conditions which are most generally intermediate between those established at the head and at the bottom of the distillation zone, at a temperature in the range 100°C. to 200° C., preferably in the range 120° C. to 180° C., and at an absolute pressure in the range 0.2 to 3 MPa, preferably in the range 0.4 to 2 MPa. The liquid undergoing hydrogenation is mixed with a gas stream comprising hydrogen the flow rate of which depends on the concentration of benzene in said liquid and, more generally, on the concentration of the unsaturated compounds containing at most six carbon atoms per molecule in the feed from the distillation zone. The hydrogen flow rate is generally equal to at least the flow rate corresponding to the stoichiometry of the hydrogenation reactions carried out (hydrogenation of benzene and other unsaturated compounds containing at most six carbon atoms per molecule, in the hydrogenation feed) and at most equal to the flow rate corresponding to 10 times the stoichiometry, preferably in the range 1 to 6 times the stoichiometry, more preferably in the range 1 to 3 times the stoichiometry. In the portion of the hydrogenation zone external to the distillation zone, the operating conditions are generally as follows. The absolute pressure required for this hydrogenation step is generally in the range 0.1 to 6 MPa absolute, preferably in the range 0.2 to 5 MPa and more preferably in the range 0.5 to 3.5 MPa. The operating temperature in the hydrogenation zone is generally in the range 100° C. to 400° C., preferably in the range 120° C. to 350° C. and more preferably in the range 140° C. to 320° C. The space velocity in said hydrogenation zone, calculated with respect to the catalyst, is generally in the range 1 to 60 and more particularly in the range 1 to 40 $h^{-1}$ (volume flow rate of feed per volume of catalyst). The hydrogen flow rate corresponding to the stoichiometry of the hydrogenation reactions carried out is in the range 1 to 10 times said stoichiometry, preferably in the range 1 to 6 times said stoichiometry and more preferably in the range 1 to 3 times said stoichiometry. However, the temperature and pressure conditions can also be comprised between those which are established at the head and at the bottom of the distillation zone in the process of the present invention.

In the context of the present description, the term "reflux ratio" means the ratio of the mass flow rate of the reflux over the mass flow rate of the supply to the column.

In the particular case when the reaction zone is a zone for hydrogenating benzene and possible olefins, the catalyst used in the hydrogenation zone generally comprises at least one metal selected from group VIII, preferably selected from the group formed by nickel and platinum, used as it is or, preferably, deposited on a support. At least 50% of the metal must generally be in its reduced form. However, any other hydrogenation catalyst which is known to the skilled person can also be used.

When using nickel, the proportion of nickel with respect to the total catalyst weight is in the range 5% to 70%, more particularly in the range 10% to 70%, and preferably in the range 15% to 65%. Further, the average nickel crystallite size in the catalyst is less than $100\times10^{-10}$ m, preferably less than $80\times10^{-10}$ m, more preferably less than $60\times10^{-10}$ m.

The support is generally selected from the group formed by alumina, silica-aluminas, silica, zeolites, activated charcoal, clays, aluminous cements, rare earth oxides and alkaline-earth oxides, used alone or as a mixture. Preferably, a support based on alumina or silica is used, with a specific surface area in the range 30 to 300 $m^2/g$, preferably in the range 90 to 260 $m^2/g$.

Figure 2:
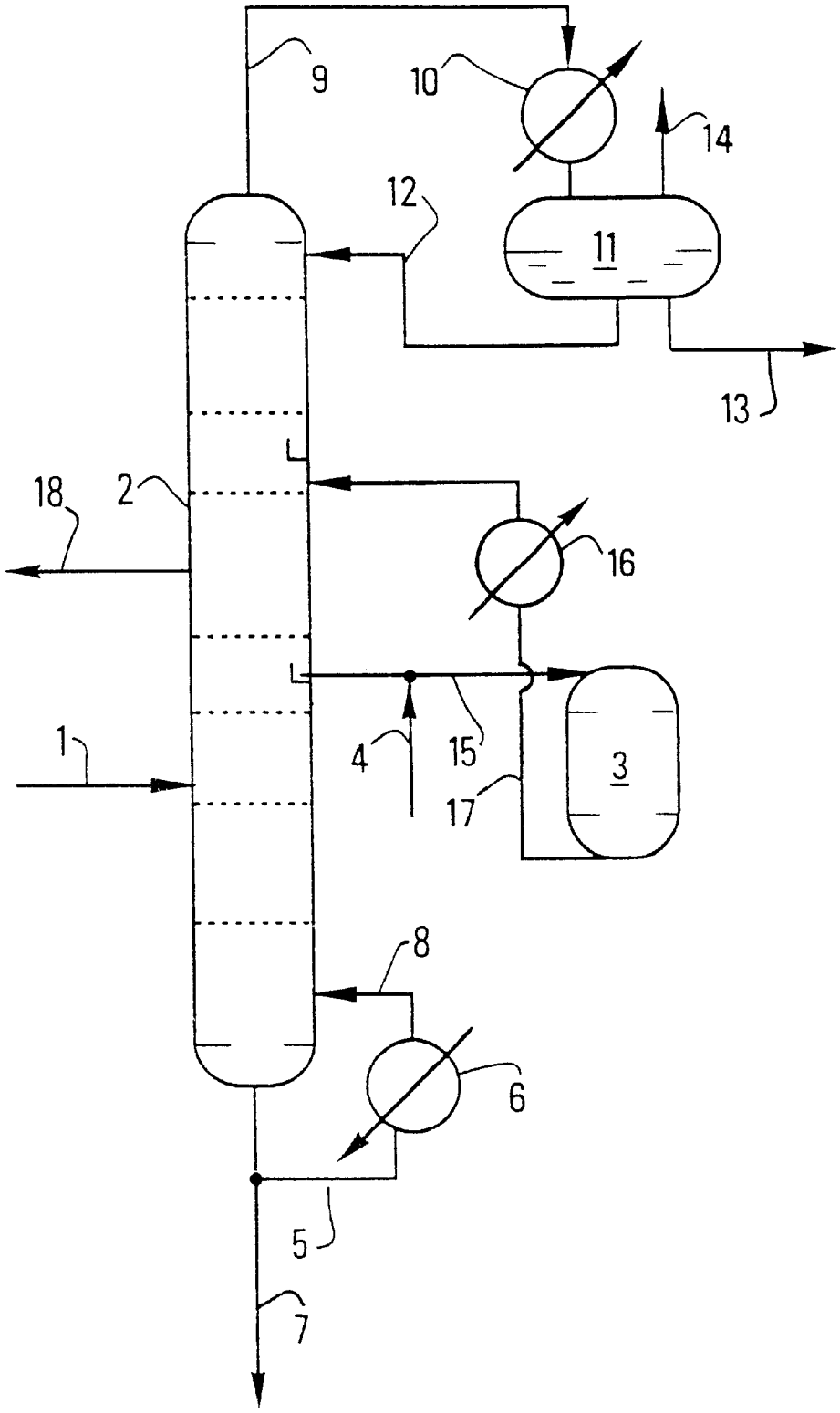

FIGS. 1 and 2 each constitute an illustration of an implementation of the process of the invention. Similar means are represented by the same numerals in each Figure.

FIG. 1 shows a first implementation of the process. The hydrocarbon feed is sent to a column 2 via a line 1. Said column contains distillation contact means, which in the case shown in FIG. 1 are plates or packing, partially represented by dotted lines.

At the foot of the column, the least volatile fraction of the reformate is recovered via a line 5, a portion is reboiled in exchanger 6 and a portion is evacuated via a line 7. The reboiling vapour is re-introduced into the column via a line 8. The stabilised liquid distillate is extracted via a line 18, hydrogen and the light hydrocarbons are sent via a line 9 to a condenser 10 then to a drum 11 from which they are extracted via a line 14 in the form of a gas purge. A portion of the liquid phase from drum 11 is returned via a line 12 to the head of the column as a reflux, and a further portion of the liquid phase is recovered via a line 13.

A liquid is drawn off via a line 15 by means of a draw-off plate located in the distillation zone, and the liquid is sent to the head of reactor 3, after adding hydrogen via a line 4. The effluent from the reactor is cooled in exchanger 16 then recycled to the column via a line 17.

In a second implementation of the process, shown in FIG. 2, the process is the same as that described for FIG. 1, the only difference being that the liquid distillate is withdrawn via line 18 from a level in the column which is below the level for re-introduction of the hydrocarbon feed into the column via line 17.

EXAMPLES

The following Examples illustrate a particular application of the invention, i.e., selective reduction of unsaturated compounds and benzene in a hydrocarbon cut. They were carried out by simulation using PRO/II® software from Simulation Sciences Incorporated.

Example 1 (comparative)

This Example used a process as described in the Applicant's patent application EP-A-0 781 830, referring to FIG. 1 of that application to which a third reactor 3*c* was added.

A metallic distillation column with a diameter of 2.90 m was used. The column comprised 45 theoretical plates from top to bottom which were numbered from top to bottom (including the condenser and the reboiler). The reboiling duty was 8900 kw.

Three hydrogenation reactors were used located outside the distillation column, together containing 37.4 $m^3$ of catalyst.

An industrial reformate feed was used. The process simulation was carried out for a flow rate of 305.9 kmol/h of reformate with the composition shown in Table 1.

The feed for the column was injected via line 1 into plate 33. The feeds for the three reactors 3*a*, 3*b* and 3*c* were drawn off from plates 6, 8 and 10 respectively via lines 15*a*, 15*b* and 15*c*. Hydrogen was introduced via lines 4*a*, 4*b* and 4*c* before entering the reactors operating in downflow mode and at 1.5 MPa absolute pressure. The reactors were loaded with 4.4, 13.4 and 16.6 $m^3$ respectively of nickel catalyst sold by PROCATALYSE with reference number LD476. The reactor positioned at the bottom of the column contained the least catalyst. The hydrogen/benzene mole ratio was 3.1. The effluents from reactors 3*a*, 3*b* and 3*c* were respectively re-injected into the column via lines 16*a*, 16*b* and 16*c* to plates 5, 7 and 9. The effluent depleted in unsaturated compounds was withdrawn from the head of the column.

The absolute pressure in the reflux drum was 0.5 MPa, the reflux temperature was 50° C. The temperature of the liquid before mixing with hydrogen was between 120° C. and 150° C. and that of the hydrogen was 25° C. The reflux/feed ratio was 1.72 by weight.

The simulated compositions of the light reformate fraction (13), purge gas (14) and heavy reformate (7) are shown in Table 1.

Example 2 (in accordance with the invention)

The unit of Example 2 is shown in FIG. 2 accompanying the text of the present application.

A distillation column with a diameter of 1.83 m was used.

The same catalyst and feed as that used in Example 1 were used, but in this case a single hydrogenation reactor was used located external to the distillation column. The feed for the column was injected via line 1 into plate 33. The feed for reactor 3 was drawn off from plate 12 via line 15. Hydrogen was introduced via line 4 before entering the reactor operating in downflow mode and at 1.5 MPa. The reactor was loaded with 8 $m^3$ of LD476 catalyst. The hydrogen/benzene mole ratio was 3.1. The effluent from reactor 3 was cooled then re-injected into the column via line 17 into plate 8. The liquid distillate (18) was withdrawn from plate number 5, hydrogen and light hydrocarbons were extracted from the reflux drum of the column (11) in the form of a vapour distillate (14). The absolute pressure in the reflux drum was 0.5 MPa. The simulated compositions of the light reformate (18), gas purge (14) and heavy reformate (7) are shown in Table 2.

Example 3: Performances of processes

Table 3 summarises the values for the RVP vapour tension, the quantity of benzene present in the final effluent constituted by the stabilised liquid distillate and the effluent from the column bottom, the reboiling duty, the total volume of the catalyst used and the diameter of the column in the process of Example 1 and in the process of Example 2.

Traffic from the upper portion of the column could produce a light reformate at a RVP (Reid Vapour Pressure) of less than 0.1 MPa. The reboiling duty was 2.7 times lower in the process of the present invention with respect to the prior art process described in Example 1. Further, the reflux ratio in the process of the present invention was 0.6 while it was 1.7 in Example 1. A further advantage of the process of the present invention was that for superior performances, only 8 $m^3$ of catalyst was used as opposed to 37.4 $m^3$ in Example 1. Finally, the process of the present invention enabled the diameter of the column to be reduced.

Examples 4, 5 and 6 describe a process with a column feed different to the feed used in Examples 1 and 2, the feed containing three times more heavy reformate.

Example 4 (comparative)

This example describes a process without stabilisation of the distillate, using a single hydrogenation reactor located external to the distillation column and re-introducing the hydrogenated feed 4 plates above the draw-off level.

The process was simulated for a flow rate of 1318.64 kmol/h of reformate with the composition defined in Table 4.

The column comprised 45 theoretical plates (including the condenser and reboiler) and had a diameter of 3.50 m.

The desired effluent depleted in olefins was withdrawn from the head of the column with the light gases. The re-introduction level into the column was higher than the draw-off level by 4 plates. The unit was similar to that of the accompanying FIG. 1 but there was no withdrawal from 18. The feed for the column was injected into plate 33 via line 1. The feed for reactor 3 was drawn off from plate 12 via line 15. Hydrogen was introduced via line 4 before entering into the reactor operating in downflow mode and at 1.5 MPa absolute pressure. The reactor was loaded with 12 $m^3$ of LD476 catalyst. The hydrogen/benzene mole ratio was 2.8. The effluent from reactor 3 was cooled by an exchanger then re-injected into the column via line 17 into plate 8. The absolute pressure in the reflux drum was 0.5 MPa. The simulated compositions for the light reformate (13), purge gas (14) and heavy reformate (7) fractions are shown in Table 4. The performances are shown in Table 7.

The reflux ratio was 0.40. The reboiling duty was 15.660 kw.

Example 5 (in accordance with the invention)

The process had a configuration in accordance with the invention with withdrawal of a stabilised liquid distillate below recovery of a vapour distillate and with a level of re-introduction of the hydrogenated feed 4 plates above the withdrawal plate. The unit is represented in FIG. 2.

The column comprised 45 theoretical plates (including the condenser and reboiler) and had a diameter of 3.20 m.

The reflux ratio with respect to the supply was 0.51. The reboiling duty was 13.370 kw.

The process was carried out with an external hydrogenation reactor containing 12 $m^3$ of catalyst and operating at an absolute pressure of 1.5 MPa.

The same catalyst and feed as those described in Example 4 were used, but the process of the present invention was carried out, i.e., the stabilised liquid distillate (light reformate) was withdrawn from plate 5 and the vapour distillate was recovered from the column head. The feed for the column was injected via line 1 into plate 33. The feed for reactor 3 was drawn off from plate 12 via line 15. Hydrogen was introduced via line 4 before entering the reactor operating in downflow mode and at 1.5 MPa absolute pressure. The reactor was loaded with 12 $m^3$ of LD476 catalyst. The hydrogen/benzene mole ratio was 3.0. The effluent from reactor 3 was cooled then re-injected into the column via line 17 to plate 8. The absolute pressure in the reflux drum was 0.5 MPa.

The simulated compositions of the stabilised liquid distillate (light reformate) (18), purge gas (14) and heavy reformate (7) fractions are shown in Table 5. The performances are shown in Table 7.

It can be seen that the process of the present invention, using a single reactor for hydrogenation of benzene and olefinic compounds in the feed, located external to the distillation zone, an exchanger for cooling the effluent, a return to a higher level in the column (+4 plates in this example), withdrawing a liquid distillate from plate 5 produced a "stabilised" liquid distillate with a reboiling duty lower than that of Example 4, and with a better benzene conversion.

Adding a pasteurisation zone with respect to the operating mode described in Example 4 improves the quality of the reformate and also the performances in terms of eliminating benzene and the reboiling duty. This configuration could produce a "stabilised" distillate, i.e., with an RVP lower than a set value; in this Example an RVP of 0.08 MPa was obtained which was far better than the RVP of Example 4 (0.41 MPa).

Further, it produced higher conversions than those described in Example 4; in this case 0.46% by volume of benzene was obtained in the product formed by the mixture of light reformate and heavy reformate compared with 0.59% by volume in Example 4 while in Example 4 the reboiling duty had been increased of the order of 20% with respect to that used in the present example.

Example 6 (in accordance with the invention)

The unit is shown in FIG. 2.

The same scheme, the same hydrogenation reactor located external to the column, the same catalyst, and the same feed was used as in Example 5 but the position for re-injecting effluent from the reactor was located 7 plates above the draw-off plate and liquid distillate was withdrawn from plate 6. The reflux ratio (reflux/supply) was 0.23. The reboiling duty was 12.350 kw.

In this Example, supplemental cooling was carried out on the reactor effluent.

The column comprised 45 theoretical plates (including the condenser and reboiler) and had a diameter of 3.05 m.

The feed for the column was injected into plate 33 via line 1. The feed for reactor 3 was withdrawn from plate 12 via line 15. Hydrogen was introduced via line 4 before entering the reactor operating in downflow mode and at 1.5 MPa absolute pressure. The reactor was loaded with 20.4 $m^3$ of LD476 catalyst. The hydrogen/benzene mole ratio was 2.9. The effluent from reactor 3 was cooled then re-injected into the column via line 17 to plate 5. The liquid distillate (18) was withdrawn from plate 6 underneath the return from line 17. The absolute pressure in the reflux drum was 0.5 MPa. The simulated compositions of the light reformate (13), purge gas (14) and heavy reformate (effluent from the column bottom) (7) fractions are shown in Table 6. The performances are shown in Table 7.

The process as carried out in this implementation enabled working with a low reboiling duty for a benzene conversion which was as good as in known processes.

Example 7: Performances of processes

Table 7 summarises the RVP vapour tensions, the quantity of benzene present in the final effluent constituted by the stabilised liquid distillate and the to effluent from the column bottom, the reboiling duty and the total volume of catalyst used.

In the process of the present invention, i.e., as described in Examples 5 and 6, for example, a liquid distillate was obtained with a vapour tension which was much lower than the vapour tension of the overhead effluent in Example 4, showing that the liquid distillate from Example 5 and Example 2 essentially contained liquid compounds containing at least 5 carbon atoms and was free of light gaseous components.

Further, the process of the invention enabled a distillation apparatus with a reduced diameter to be used.

Finally, one of the implementations of the process of the present invention in which the reactor was completely external enabled a lower reboiling duty to be employed, i.e., in exchanger 6, the energy to vaporise a portion of the least volatile fraction of the reformate recovered from the column bottom and re-introduced into the column was reduced.

TABLE 1

Composition and flow rate of feed and effluents for Example 1

| Substance/Kmole s/h | Feed | $H_2$ | Gas purge | Light reformate | Heavy reformate |
|---|---|---|---|---|---|
| $H_2$ | 0.00 | 60.05 | 5.13 | 0.39 | 0.00 |
| Methane | 0.00 | 2.30 | 1.74 | 0.57 | 0.00 |
| Ethane | 0.00 | 1.84 | 0.83 | 1.01 | 0.00 |
| Propane | 0.00 | 1.05 | 0.18 | 0.87 | 0.00 |
| Butanes | 17.20 | 0.53 | 1.34 | 16.39 | 0.00 |
| Iso-pentanes | 15.14 | | 0.54 | 14.60 | 0.00 |
| Normal pentanes | 24.61 | | 0.70 | 23.91 | 0.00 |
| Dimethylbutanes | 24.24 | | 0.38 | 23.86 | 0.00 |
| Hexanes | 16.15 | | 0.14 | 16.21 | 0.02 |
| C7 paraffins | 21.39 | | 0.00 | 0.00 | 21.39 |
| C8 paraffins | 1.37 | | 0.00 | 0.00 | 1.37 |
| Methylcyclopentane | 26.24 | | 0.23 | 25.69 | 0.31 |
| Cyclohexane | 0.00 | | 0.02 | 4.04 | 14.03 |
| Methylcydohexane | 0.00 | | 0.00 | 0.00 | 0.00 |
| Hexenes | 0.22 | | 0.00 | 0.00 | 0.00 |
| Benzene | 19.42 | | 0.00 | 0.11 | 1.21 |
| Toluene | 40.72 | | 0.00 | 0.00 | 40.72 |
| C8 aromatics | 40.20 | | 0.00 | 0.00 | 40.20 |
| C9 aromatics | 24.98 | | 0.00 | 0.00 | 24.98 |
| C10 aromatics | 34.02 | | 0.00 | 0.00 | 34.02 |
| | 305.90 | 65.77 | 11.23 | 127.66 | 178.26 |

TABLE 2

Composition and flow rate of feed and effluents for Example 2

| Substance/Kmole s/h | Feed | $H_2$ | Gas purge | Light reformate | Heavy reformate |
|---|---|---|---|---|---|
| $H_2$ | 0.00 | 59.80 | 5.20 | 0.02 | 0.00 |
| Methane | 0.00 | 2.29 | 2.26 | 0.03 | 0.00 |
| Ethane | 0.00 | 1.83 | 1.79 | 0.04 | 0.00 |
| Propane | 0.00 | 1.05 | 0.97 | 0.07 | 0.00 |
| Butanes | 17.20 | 0.52 | 11.87 | 5.85 | 0.00 |
| Iso-pentanes | 15.14 | | 0.93 | 14.21 | 0.00 |
| Normal pentanes | 24.61 | | 0.88 | 23.74 | 0.00 |
| Dimethylbutanes | 24.24 | | 0.04 | 24.20 | 0.00 |
| Hexanes | 16.15 | | 0.00 | 16.35 | 0.02 |
| C7 paraffins | 21.39 | | 0.00 | 0.01 | 21.38 |
| C8 paraffins | 1.37 | | 0.00 | 0.00 | 1.37 |
| Methylcyclopentane | 26.24 | | 0.00 | 26.06 | 0.18 |
| Cyclohexane | 0.00 | | 0.00 | 17.97 | 0.15 |
| Methylcyclohexane | 0.00 | | 0.00 | 0.00 | 0.00 |
| Hexenes | 0.22 | | 0.00 | 0.00 | 0.00 |
| Benzene | 19.42 | | 0.00 | 0.17 | 1.13 |
| Toluene | 40.72 | | 0.00 | 0.00 | 40.72 |
| C8 aromatics | 40.20 | | 0.00 | 0.00 | 40.20 |
| C9 aromatics | 24.98 | | 0.00 | 0.00 | 24.98 |
| C10 aromatics | 34.02 | | 0.00 | 0.00 | 34.02 |
| | 305.90 | 65.49 | 23.95 | 128.71 | 164.15 |

TABLE 3

| Example | 1 | 2 |
|---|---|---|
| RVP MPa | 0.41 | 0.09 |
| Benzene, vol % | 0.31 | 0.31 |
| Q reboiling 1.E6 kcal/h | 8.900 | 3.340 |
| Total catalyst volume $m^3$ | 37.4 | 8 |
| Column diameter m | 2.90 | 1.83 |

TABLE 4

Composition and flow rate of feed and effluents for Example 4

| Substance/Kmole s/h | Feed | $H_2$ | Gas purge | Light reformate | Heavy reformate |
|---|---|---|---|---|---|
| $H_2$ | 0.00 | 218.24 | 10.41 | 1.02 | 0.00 |
| Methane | 0.00 | 8.37 | 5.71 | 2.66 | 0.00 |
| Ethane | 0.00 | 6.69 | 2.38 | 4.31 | 0.00 |
| Propane | 0.00 | 3.82 | 0.51 | 3.32 | 0.00 |
| Butanes | 18.00 | 1.91 | 1.00 | 18.91 | 0.00 |
| Iso-pentanes | 63.54 | | 1.63 | 61.91 | 0.00 |
| Normal pentanes | 46.43 | | 0.97 | 46.32 | 0.00 |
| Dimethylbutanes | 18.50 | | 0.21 | 18.29 | 0.00 |
| Other C6 paraffins | 109.27 | | 0.90 | 111.17 | 0.02 |
| C7 paraffins | 60.75 | | 0.11 | 34.24 | 26.80 |
| C8 paraffins | 7.46 | | 0.00 | 0.00 | 7.46 |
| C9 + paraffins | 3.47 | | 0.00 | 0.00 | 3.47 |
| Cyclopentane | 2.99 | | 0.04 | 2.95 | 0.00 |
| Methylcyclopentane | 5.00 | | 0.03 | 4.95 | 0.03 |
| Cyclohexane | 0.83 | | 0.31 | 66.42 | 0.19 |
| Methylcyclohexane | 4.50 | | 0.00 | 0.06 | 5.93 |
| C8 naphthenes | 0.62 | | 0.00 | 0.00 | 0.62 |
| Pentenes | 2.37 | | 0.04 | 1.46 | 0.00 |
| Hexenes | 3.32 | | 0.00 | 0.49 | 0.00 |
| Heptenes | 1.60 | | 0.00 | 0.00 | 1.17 |
| Benzene | 76.77 | | 0.05 | 7.15 | 3.5 |
| Toluene | 331.01 | | 0.00 | 0.00 | 329.52 |
| C8 aromatics | 371.99 | | 0.00 | 0.00 | 371.99 |
| C9 aromatics | 165.74 | | 0.00 | 0.00 | 165.74 |
| C10 aromatics | 24.49 | | 0.00 | 0.00 | 24.49 |
| TOTAL | 1318.64 | 239.04 | 24.32 | 385.62 | 940.93 |

TABLE 5

Composition and flow rate of feed and effluents for Example 5

| Substance/Kmole s/h | Feed | $H_2$ | Gas purge | Light reformate | Heavy reformate |
|---|---|---|---|---|---|
| $H_2$ | 0.00 | 230.20 | 14.23 | 0.04 | 0.00 |
| Methane | 0.00 | 8.82 | 8.74 | 0.09 | 0.00 |
| Ethane | 0.00 | 7.06 | 6.94 | 0.12 | 0.00 |
| Propane | 0.00 | 4.03 | 3.84 | 0.20 | 0.00 |
| Butanes | 18.00 | 2.02 | 14.90 | 5.12 | 0.00 |
| Iso-pentanes | 63.54 | | 6.69 | 56.85 | 0.00 |
| Normal pentanes | 46.43 | | 2.30 | 45.24 | 0.00 |
| Dimethylbutanes | 18.50 | | 0.06 | 18.43 | 0.00 |
| Other C6 paraffins | 109.27 | | 0.09 | 112.24 | 0.01 |
| C7 paraffins | 60.75 | | 0.00 | 44.27 | 17.26 |
| C8 paraffins | 7.46 | | 0.00 | 0.00 | 7.46 |
| C9 + paraffins | 3.47 | | 0.00 | 0.00 | 3.47 |
| Cyclopentane | 2.99 | | 0.02 | 2.97 | 0.00 |
| Methylcyclopentane | 5.00 | | 0.00 | 4.98 | 0.02 |
| Cyclohexane | 0.83 | | 0.00 | 69.35 | 0.07 |
| Methylcyclohexane | 4.50 | | 0.00 | 0.36 | 5.87 |
| C8 naphthenes | 0.62 | | 0.00 | 0.00 | 0.62 |
| Pentenes | 2.37 | | 0.15 | 1.11 | 0.00 |
| Hexenes | 3.32 | | 0.00 | 0.24 | 0.00 |
| Heptenes | 1.60 | | 0.00 | 0.01 | 0.80 |
| Benzene | 76.77 | | 0.00 | 4.20 | 4.00 |
| Toluene | 331.01 | | 0.00 | 0.00 | 329.27 |
| C8 aromatics | 371.99 | | 0.00 | 0.00 | 371.99 |
| C9 aromatics | 165.74 | | 0.00 | 0.00 | 165.74 |
| C10 aromatics | 24.49 | | 0.00 | 0.00 | 24.49 |
| TOTAL | 1318.64 | 252.14 | 57.96 | 365.82 | 931.07 |

TABLE 6

Composition and flow rate of feed and effluents for Example 6

| Substance/Kmole s/h | Feed | $H_2$ | Gas purge | Light reformate | Heavy reformate |
|---|---|---|---|---|---|
| $H_2$ | 0.00 | 223.67 | 9.94 | 0.00 | 0.00 |
| Methane | 0.00 | 8.57 | 8.56 | 0.01 | 0.00 |
| Ethane | 0.00 | 6.86 | 6.83 | 0.03 | 0.00 |
| Propane | 0.00 | 3.92 | 3.80 | 0.12 | 0.00 |
| Butanes | 18.00 | 1.96 | 14.04 | 5.92 | 0.00 |
| Iso-pentanes | 63.54 | | 5.71 | 57.83 | 0.00 |
| Normal pentanes | 46.43 | | 1.94 | 46.35 | 0.00 |
| Dimethylbutanes | 18.50 | | 0.05 | 18.45 | 0.00 |
| Other C6 paraffins | 109.27 | | 0.08 | 112.46 | 0.03 |
| C7 paraffins | 60.75 | | 0.00 | 41.93 | 19.36 |
| C8 paraffins | 7.46 | | 0.00 | 0.00 | 7.46 |
| C9 + paraffins | 3.47 | | 0.00 | 0.00 | 3.47 |
| Cyclopentane | 2.99 | | 0.02 | 2.97 | 0.00 |
| Methylcyclopentane | 5.00 | | 0.00 | 4.96 | 0.04 |
| Cyclohexane | 0.83 | | 0.00 | 69.27 | 0.12 |
| Methylcyclohexane | 4.50 | | 0.00 | 0.44 | 4.84 |
| C8 naphthenes | 0.62 | | 0.00 | 0.00 | 0.62 |
| Pentenes | 2.37 | | 0.04 | 0.46 | 0.00 |
| Hexenes | 3.32 | | 0.00 | 0.01 | 0.00 |
| Heptenes | 1.60 | | 0.00 | 0.01 | 1.05 |
| Benzene | 76.77 | | 0.00 | 1.13 | 7.09 |
| Toluene | 331.01 | | 0.00 | 0.01 | 330.22 |
| C8 aromatics | 371.99 | | 0.00 | 0.00 | 371.99 |
| C9 aromatics | 165.74 | | 0.00 | 0.00 | 165.74 |
| C10 aromatics | 24.49 | | 0.00 | 0.00 | 24.49 |
| TOTAL | 1318.64 | 244.99 | 51.01 | 362.35 | 936.53 |

TABLE 7

| Example | 4 | 5 | 6 |
|---|---|---|---|
| RVP MPa | 0.41 | 0.08 | 0.06 |
| Benzene, vol % | 0.56 | 0.46 | 0.46 |
| Q reboiling 1.E6 kcal/h | 15.660 | 13.370 | 12.350 |
| Total catalyst volume $m^3$ | 12 | 12 | 20.4 |
| Column diameter m | 0.50 | 3.20 | 3.050 |

The preceding examples can be repeated with similar success by substituting the generically or specifically described reactants and/or operating conditions of this invention for those used in the preceding examples. Also, the preceding specific embodiments are to be construed as merely illustrative, and not limitative of the remainder of the disclosure in any way whatsoever.

The entire disclosure of all applications, patents and publications, cited above and below, and of corresponding French application 98/04.351, are hereby incorporated by reference.

From the foregoing description, one skilled in the art can easily ascertain the essential characteristics of this invention, and without departing from the spirit and scope thereof, can make various changes and modifications of the invention to adapt it to various usages and conditions.

What is claimed is:

1. A process for converting a hydrocarbon feed in which said feed is treated in a distillation zone producing an overhead vapour distillate and a bottom effluent, associated with an at least partially external reaction zone and comprising at least one catalytic bed, in which at least one reaction for converting at least a portion of at least one hydrocarbon is carried out in the external presence of a catalyst and a gas stream comprising hydrogen, the feed for the reaction zone being drawn off at the height of at least one draw-off level and representing at least a portion of the liquid flowing in the external distillation zone, at least part of the effluent from the reaction zone being re-introduced into the distillation zone at the height of at least one re-introduction level, so as to ensure continuity of distillation, said process being characterized in that a liquid distillate is withdrawn from the distillation zone at the height of at least one withdrawal level, said level being located below the vapour distillate withdrawal level.

2. A process according to claim 1, comprising a single level for drawing off the feed for the reaction zone.

3. A process according to claim 1, in which the level for withdrawing the liquid distillate is located above the level for drawing off the feed for the reaction zone.

4. A process according to claim 1, in which the level for re-introducing effluent from the reaction zone is located above the level for drawing off feed for the reaction zone.

5. A process according to claim 4, in which the level for re-introducing effluent from the reaction zone is at at least the second theoretical plate above the level for drawing off feed for the reaction zone.

6. A process according to claim 1, in which the reaction zone is completely external to the distillation zone.

7. A process according to claim 1, in which distillation is carried out at an absolute pressure in the range 0.1 to 2.5 MPa with a reflux ratio in the range 0.1 to 20 and at a temperature in the range 10° C. to 300° C.

8. A process according to claim 1, in which for the portion of the conversion reaction external to the distillation zone, the absolute pressure required for this conversion step is in the range 0.1 to 6 MPa, the temperature is in the range 30° C. to 400° C., the space velocity in the conversion zone, calculated with respect to the catalyst, is in the range 0.5 to 60 $h^{-1}$ (volume of feed per volume of catalyst per hour) and the hydrogen flow rate is in the range one to ten times the flow rate corresponding to the stoichiometry of the conversion reactions carried out.

9. A process according to claim 1, in which said feed comprises a major portion of hydrocarbons comprising at least 5 carbon atoms per molecule said hydrocarbons comprising at least one unsaturated compound said at least one unsaturated compound comprising benzene and optionally at least one olefin.

10. A process according to claim 9, in which the reaction zone is a hydrogenation zone, in which at least a portion of unsaturated compounds containing at most six carbon atoms per molecule and contained in the feed is hydrogenated in the presence of a hydrogenation catalyst.

11. A process according to claim 9, in which distillation is carried out at an absolute pressure in the range 0.2 to 2 MPa, with a reflux ratio in the range 0.1 to 10, the temperature at the head of the distillation zone being in the range 30° C. to 180° C. and the temperature at the bottom of the distillation zone being in the range 120° C. to 280° C.

12. A process according to claim 9 in which, for the portion of the hydrogenation reaction external to the distillation zone, the absolute pressure required for the hydrogenation step is in the range 0.1 to 6 MPa, the temperature is in the range 100° C to 400° C., the space velocity in the hydrogenation zone, calculated with respect to the catalyst, is in the range 1 to 60 $h^{-1}$ (volume of feed per volume of catalyst per hour), and the hydrogen flow rate is in the range one to ten times the flow rate corresponding to the stoichiometry of the hydrogenation reactions carried out.

13. A process according to claim 12, further comprising conducting a hydrogenation reaction internal to the distillation zone wherein the hydrogenation step is carried out at a temperature of 100° C. to 200° C., at an absolute pressure in the range 0.2 to 3 MPa, and the hydrogen flow rate supplying the hydrogenation zone is in the range one to ten times the flow rate corresponding to the stoichiometry of the hydrogenation reactions carried out.

14. A process according to claim 9, in which the catalyst used in the hydrogenation reaction zone comprises at least one metal selected from the group consisting of nickel and platinum.

15. A process according to claim 1, wherein the effluent from the external reaction zone is reintroduced into the reaction zone without any intervening separation of said effluent.

16. A process according to claim 15, wherein said effluent from the external reaction zone is cooled prior to being directly reintroduced into the distillation zone.

17. A process according to claim 1 wherein the liquid distillate is mostly free of excess hydrogen and light gases.

18. A process according to claim 1 wherein the hydrocarbon feed comprises benzene and wherein the liquid distillate essentially comprises compounds containing at least 5 carbon atoms.

* * * * *

UNITED STATES PATENT AND TRADEMARK OFFICE

CERTIFICATE OF CORRECTION

PATENT NO. : 6,261,442 B1
APPLICATION NO. : 09/285679
DATED : July 17, 2001
INVENTOR(S) : Jean-Louis Ambrosino et al.

It is certified that error appears in the above-identified patent and that said Letters Patent is hereby corrected as shown below:

Column 14, line 64, delete “external”
Column 14, line 66, reads “the reaction” should read -- the external reaction --
Column 15, line 1, delete “external”
Column 15, line 2, reads “the reaction” should read -- the external reaction --

Signed and Sealed this

Twentieth Day of February, 2007

JON W. DUDAS
*Director of the United States Patent and Trademark Office*